US009039435B2

(12) United States Patent
Horiuchi

(10) Patent No.: US 9,039,435 B2
(45) Date of Patent: May 26, 2015

(54) GROUND TERMINAL ASSEMBLY STRUCTURE

(71) Applicant: Sumitomo Wiring Systems, Ltd., Yokkaichi, Mie (JP)

(72) Inventor: Hidefumi Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 59 days.

(21) Appl. No.: 13/909,693

(22) Filed: Jun. 4, 2013

(65) Prior Publication Data

US 2013/0267105 A1 Oct. 10, 2013

(51) Int. Cl.

| | |
|---|---|
| ***H01R 13/28*** | (2006.01) |
| ***H01R 13/652*** | (2006.01) |
| ***H01R 4/64*** | (2006.01) |
| ***H01R 11/09*** | (2006.01) |
| ***H01R 11/12*** | (2006.01) |
| *H01R 4/34* | (2006.01) |

(52) U.S. Cl.

CPC ..... *H01R 13/652* (2013.01); *H01R 4/34* (2013.01); *H01R 4/64* (2013.01); *H01R 11/09* (2013.01); *H01R 11/12* (2013.01); *H01R 2201/26* (2013.01)

(58) Field of Classification Search

CPC .... H01R 13/28; H01R 4/64; H01R 13/65862; H01R 27/00; H01R 31/02; H01R 4/20

USPC ..... 439/92, 95, 284–288, 518, 801, 883, 439/907; 174/84 C

See application file for complete search history.

(56) References Cited

U.S. PATENT DOCUMENTS

| | | | | |
|---|---|---|---|---|
| 2,533,200 | A | 9/1945 | Rogoff | |
| 2,877,442 | A | 7/1956 | Gettig | |
| 4,488,770 | A | 12/1984 | Lui et al. | |
| 5,558,531 | A * | 9/1996 | Ikeda et al. | 439/287 |
| 5,577,927 | A * | 11/1996 | Okada et al. | 439/287 |
| 5,759,055 | A * | 6/1998 | Colantuano et al. | 439/287 |
| 5,934,923 | A * | 8/1999 | Matsuoka et al. | 439/287 |
| 6,086,399 | A * | 7/2000 | Matsunaga et al. | 439/287 |
| 6,476,325 | B2 * | 11/2002 | Kondo | 174/84 C |
| 6,530,795 | B2 * | 3/2003 | Maeda et al. | 439/287 |
| 6,786,751 | B2 * | 9/2004 | Maeda et al. | 439/287 |

(Continued)

FOREIGN PATENT DOCUMENTS

| | | |
|---|---|---|
| FR | 1392962 | 3/1965 |
| FR | 2842656 | 1/2004 |

(Continued)

*Primary Examiner* — Thanh Tam Le

(74) *Attorney, Agent, or Firm* — Gerald E. Hespos; Michael J. Porco; Matthew T. Hespos

(57) ABSTRACT

A ground terminal assembly includes ground terminals (10A, 10B) and a connecting fitting (30). Each ground terminal (10A, 10B) has a main portion (11A, 11B) with a bolt insertion hole (12). A barrel (20A, 20B) extends from the main portion (11A, 11B) and can be crimped to a ground wire W. The connecting fitting (30) has superimposing portions (31A, 31B) formed with bolt insertion holes (32) and on which the main portions (11A, 11B) of the ground terminals (10A, 10B) are placed. The barrels (20A, 20B) of the ground terminals (10A, 10B) are arranged so that their extending ends (22) come close to each other when the main portions (11A, 11B) of the ground terminals (10A, 10B) are placed on and connected to the corresponding superimposing portions (31A, 31B) of the connecting fitting (30) at positions where the bolt insertion holes (12, 32) align.

4 Claims, 6 Drawing Sheets

(56) References Cited

U.S. PATENT DOCUMENTS

| | | | | |
|---|---|---|---|---|
| 6,969,276 | B2 * | 11/2005 | Ono et al. | 439/518 |
| 7,294,008 | B2 * | 11/2007 | Fukuyama | 439/287 |
| 8,747,139 | B2 * | 6/2014 | Amano | 439/287 |
| 2003/0124917 | A1 | 7/2003 | Aoyama | |
| 2005/0003703 | A1 | 1/2005 | Ono et al. | |
| 2010/0084205 | A1 | 4/2010 | Tarchinski et al. | |
| 2011/0061932 | A1 | 3/2011 | Ogawa et al. | |

FOREIGN PATENT DOCUMENTS

| | | |
|---|---|---|
| JP | 07263059 | 10/1995 |
| JP | 08250165 | 9/1996 |
| JP | 08268183 | 10/1996 |
| JP | 2004-253167 | 9/2004 |
| JP | 2004253167 | 9/2004 |

* cited by examiner

GROUND TERMINAL ASSEMBLY STRUCTURE

BACKGROUND

1. Field of the Invention

The invention relates to a ground terminal assembly structure.

2. Description of the Related Art

A plurality of vehicle mounted devices conventionally are grounded by connecting ground terminals to ends of ground wires drawn out from the respective devices, placing the ground terminals one above another on a body or the like of an automotive vehicle and fixing the ground terminals to the body by a bolt.

Ground terminals that are bolted at one position may not be grounded precisely if the bolt is loosened due to vibration or the like. Accordingly, Japanese Unexamined Patent Publication No. 2004-253167 discloses bolting ground terminals at two positions. More particularly, left and right ground terminals are proposed in this literature. Each ground terminal has a main portion in the form of a wide plate. Two bolt insertion holes are formed at a predetermined distance from each other in the main portion, and barrels to be crimped and connected to ends of ground wires extend parallel to each other from positions at mutually spaced sides of the base end edges of the respective main portions.

The main portions of the ground terminals are placed one on the other with the left and right bolt insertion holes aligned. Bolts then are inserted individually through the left and right bolt insertion holes and are screwed into a body of an automotive vehicle to form a grounding structure bolted at two positions.

The ground wires of the above grounding structure are formed into a harness in advance by taping and then are brought to an operation site for bolting and grounding. The ground wires are drawn out in parallel while being spaced apart by a relatively long distance when the main portions of the both ground terminals are placed one on the other in the conventional grounding structure. Thus, both drawn-out ground wires must be wound with tape after being brought close to each other while the main portions are kept placed on one another. This tape winding operation requires considerable time and effort.

The present invention was completed in view of the above situation and an object thereof is to enable an operation of forming ground wires into a harness to be efficiently performed.

SUMMARY OF THE INVENTION

The invention relates to a ground terminal assembly structure with a plurality of ground terminals. Each ground terminal has a main portion formed with a bolt insertion hole. A wire connection portion extends from the main portion and is configured to be connected to a ground wire. The ground terminal assembly structure also includes a fitting with a plurality of superimposing portions formed with bolt insertion holes and on which the main portions of the ground terminals are to be placed and connected. The wire connection portions of the respective ground terminals are arranged so that extending ends thereof come close to each other when the main portions of the respective ground terminals are placed on and connected to the corresponding superimposing portions of the fitting at proper positions where the bolt insertion holes substantially are aligned.

The wire connecting portion of each ground terminal may be a barrel configured to be crimped and connected to an end of a ground wire.

The extending ends of the barrels of the respective ground terminals are arranged close to one another or converge when the respective ground terminals are placed properly on and connected to the corresponding superimposing portions of the fitting. As a result, the ground wires drawn out from the respective barrels are close to each other at a position immediately behind the barrels. Specifically, the respective ground terminals are assembled in a specified positional relationship via the connecting fitting and the ground wires drawn out from the respective ground terminals are brought close to each other immediately behind the barrels. Therefore, the ground wires can be bundled efficiently into a harness and taped, clamped or arranged in a corrugated or heat-shrinkable tube.

The ground wires drawn out from the barrels could not be brought close to each other immediately behind the barrels if the barrels were parallel when the ground terminals are assembled to the fitting. Rather, the ground wires could be brought close to each other only after extending a certain distance straight. Thus, an extra length would be necessary and this extra length takes up space. However, the ground wires drawn out from the barrels of the ground terminal assembly structure of the invention come close to each other or converge at a position immediately behind the wire barrels. Thus, the ground wires need not have an extra length and space saving is realized.

The ground terminals are bolted at plural positions. However, the ground terminals are assembled via the fitting. Thus, operations of aligning and positioning the bolt insertion holes of the ground terminals with respect to the mating member can be performed at once, and a grounding operation can be performed efficiently.

The ground terminals may define left and right ground terminals and the wire connection portions may extend substantially parallel to each other if the main portions thereof were placed one on another.

The fitting may be bent to have a mountain shape with two laterally arranged superimposing portions aligned at a specified angle with respect to each other and preferably at an obtuse angle.

When the first and second ground terminals are respectively placed on and connected to the corresponding superimposing portions of the fitting, the barrels of the respective ground terminals are inclined in postures to bring their extending ends close to each other due to the bent mountain shape of the fitting. Thus, ground terminals having existing shapes can be used.

Alternatively, the ground terminals may be formed so that the wire connection portions extend obliquely from the main portions to bring the extending ends close to each other and the fitting may be formed so that the superimposing portions are arranged laterally on a straight line. Thus, the linear fitting of this embodiment is simple to produce.

The assembled ground terminals and connecting fitting are fixed to the mating member by inserting bolts through the bolt insertion holes and screwing the bolts into nuts provided on the mating member or inserting stud bolts standing on the mating member through the bolt insertion holes and tightening nuts threadably engaged with the stud bolts. The assembly may be dragged to turn due to frictional engagement between the bolts or the nuts to be tightened and a fastening surface of the assembly. However, the fitting may have a drag turning preventing piece that is engageable with a mating member to which the fitting is to be bolted for preventing drag turning during bolting. Therefore, the bolts or the nuts can be tightened efficiently, and an operation of fixing the assembly to the mating member can be performed in a short time.

These and other features and advantages of the invention will become more apparent upon reading the following detailed description and accompanying drawings. It should be understood that even though embodiments are separately described, single features thereof may be combined to additional embodiments.

DETAILED DESCRIPTION OF THE PREFERRED EMBODIMENTS

Figure 1:
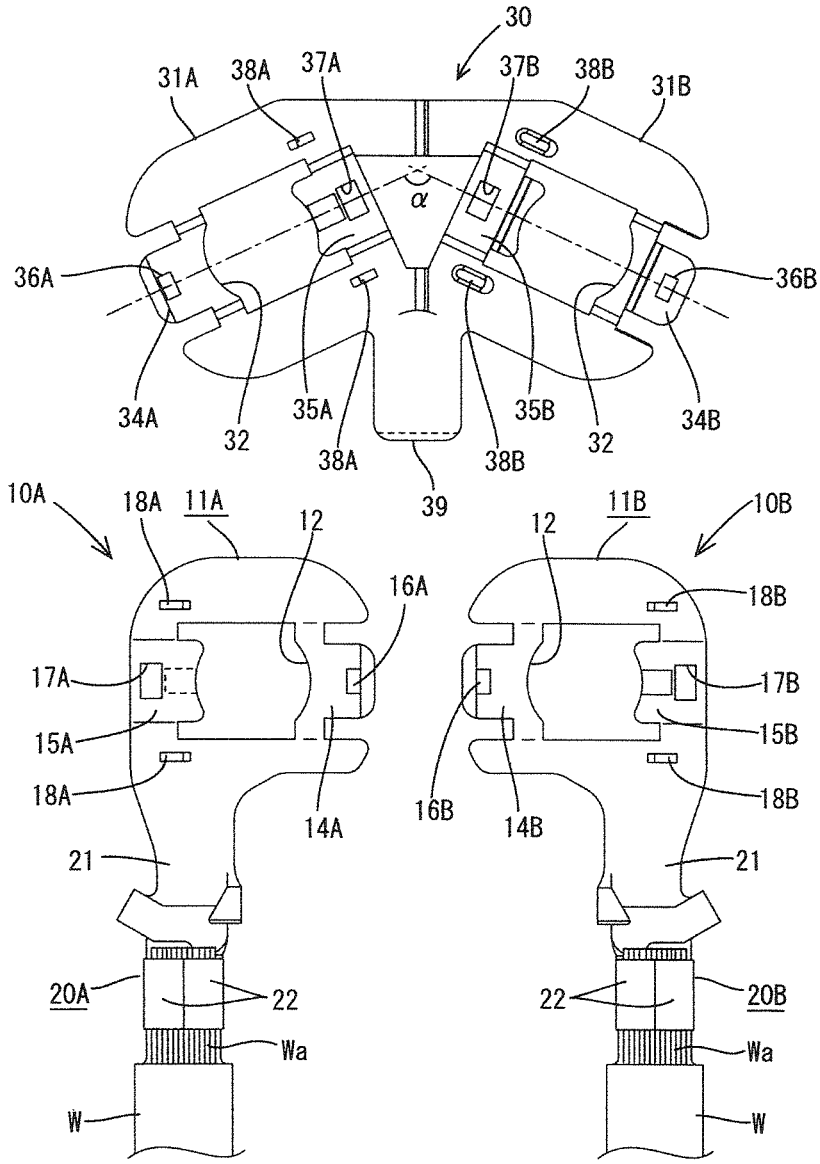
FIG. 1 is a plan view showing a state before ground terminals according to a first embodiment of the present invention are assembled with a connecting fitting.
Figure 2:
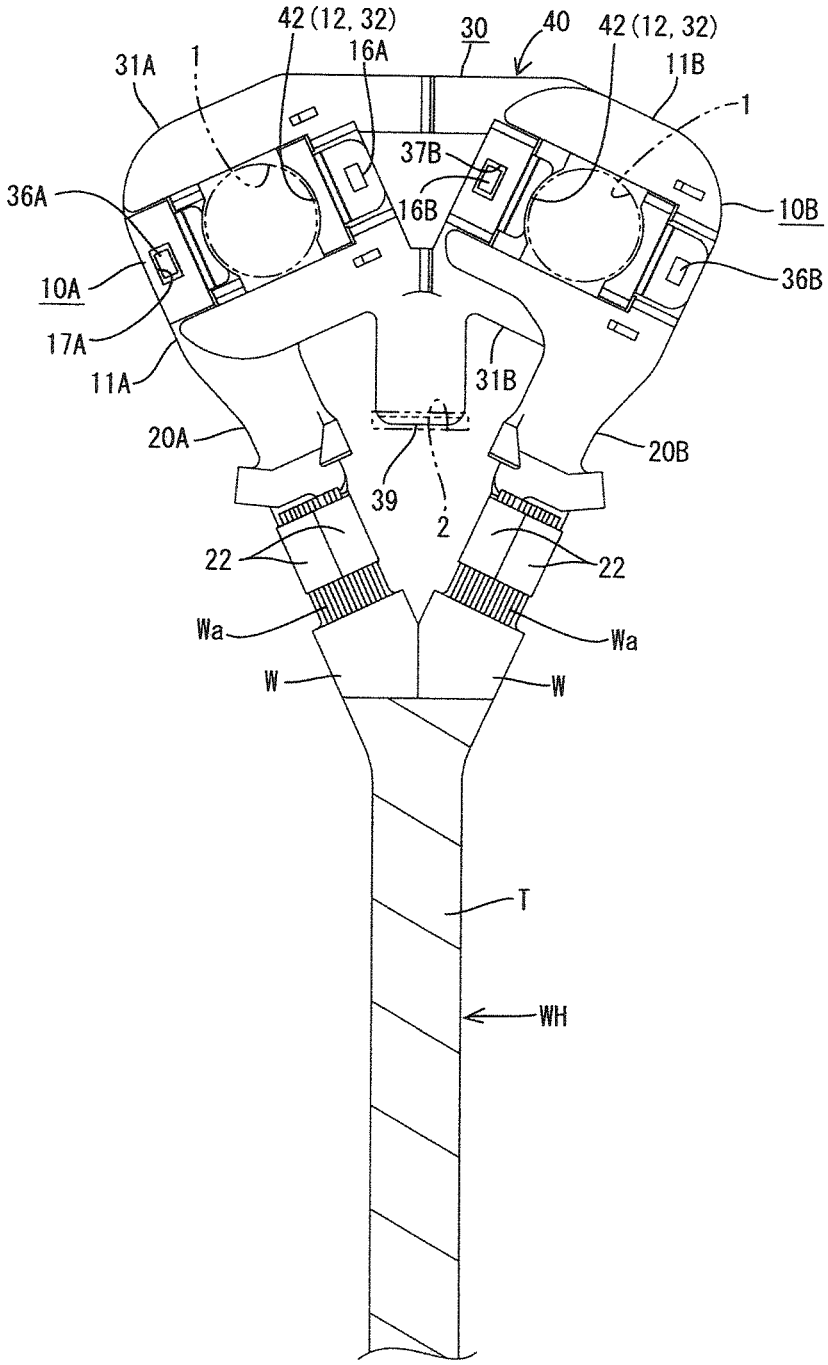
FIG. 2 is a plan view showing a state after the ground terminals are assembled with the connecting fitting.

A first embodiment of the invention is described with reference to FIGS. 1 to 3. As shown in FIG. 1, this first embodiment includes a first ground terminal 10A and a second ground terminal 10B, which are laterally paired, and a fitting 30 with which the ground terminals 10A, 10B are to be assembled. The both ground terminals 10A, 10B particularly substantially have the same shapes as existing ones which are placed one on the other and grounded to a body of an automotive vehicle by bolting.

The ground terminals 10A, 10B particularly are formed to have substantially bilaterally symmetrical outer shapes e.g. by particularly press-working a conductive metal plate with excellent electrical conductivity and/or include a substantially rectangular main portion 11A, 11B formed with a bolt insertion hole 12 substantially in the center and a wire connection portion comprising at least one wire barrel 20A, 20B substantially extending back (down in FIG. 1) from the base end edge of the main portion 11A, 11B.

The main portion 11B of the second ground terminal 10B arranged on the right side is to be placed on a surface of the main portion 11A of the first ground terminal 10A arranged on the left side while being laterally slid e.g. to the left. An inserting portion 14A, 14B and a receiving portion 15A, 15B into which the mating inserting portion 14B, 14A is to be inserted are formed at both lateral (left and right) sides of the bolt insertion hole 12 of the main portion 11A, 11B of each ground terminal 10A, 10B. The inserting portions 14A, 14B particularly are located at sides closer to the mating ground terminals and the receiving portions 15A, 15B particularly are located at distant sides, and the both inserting and receiving portions are formed to face toward the mating ground terminals.

However, in the left first ground terminal 10A, both the inserting portion 14A and the receiving portion 15A are raised by the thickness of the conductive metal plate with respect to the main portion 11A. Conversely, in the right second ground terminal 10B, both the inserting portion 14B and the receiving portion 15B are lowered by the thickness of the conductive metal plate with respect to the main portion 11B.

The inserting portion 14A of the first ground terminal 10A is struck or stamped or deformed to form a locking claw 16 on the underside, and the inserting portion 14B of the second ground terminal 10B is struck or stamped or deformed to form a locking claw 16B on the top side. The both inserting portions 15A, 15B are formed with locking holes 17A, 17B into which the mating locking claws 16B, 16A are to be at least partly fitted. In other words, the mating locking claws 16B, 16A are to be engaged with the respective locking holes 17A, 17B of the inserting portions 15A, 15B.

Further, the main portion 11A of the first ground terminal 10A is struck or stamped or deformed at one or both of front and rear sides of the inserting portion 15A to form one or more shake preventing ribs 18A on the top side, and the main portion 11B of the first ground terminal 10B is struck or stamped or deformed at one or both of front and rear sides of the inserting portion 15B to form one or more respective shake preventing ribs 18B on the underside.

The wire barrel 20A, 20B is such that an extending portion 21 substantially extends backward from a position at a side distant from the mating ground terminal near an end part on the base end edge of the main portion 11A, 11B of the corresponding ground terminal 10A, 10B and barrel pieces 22 to be crimped, folded or bent or deformed and connected to a core Wa of a ground wire W are formed on an extending end of the extending portion 21.

The connecting fitting 30 is formed by press-working or stamping the same conductive metal plate as the material of the above ground terminals 10A, 10B. The fitting 30 is formed such that a first superimposing portion 31A on the underside of which the main portion 11A of the first ground terminal 10A is to be placed and a second superimposing portion 31B on the top side of which the main portion 11B of the second ground terminal 10B is to be placed are arranged laterally so that center lines thereof intersect at a specified obtuse angle $\alpha$ (particularly being in a range of about 100° to about 150°, more particularly e.g. about 130°), and is bent or shaped into a mountain or pointed shape.

The first and second superimposing portions 31A, 31B are respectively formed to have substantially the same shapes as the main portion 11B of the second ground terminal 10B and the main portion 11A of the first ground terminal 10A, and/or the first superimposing portion 31A is arranged at a position higher by the thickness of the conductive metal plate, thereby forming a step.

Each superimposing portion 31A, 31B is formed with a bolt insertion hole 32 to be substantially aligned with the bolt insertion hole 12 of the ground terminal 10A, 10B. The both bolt insertion holes 32 are formed while being spaced apart by the substantially same distance as a spacing between two screw holes 1 (see FIG. 2: actually screw holes of nuts fixed to the underside of the body) formed in a mounting surface of the body of the automotive vehicle for grounding.

As shown in FIG. 1, the first superimposing portion 31A is formed with an inserting portion 34A and a receiving portion 35A at both left and right sides of the bolt insertion hole 32 and both the inserting portion 34A and the receiving portion 35A face outward. These inserting portion 34A and receiving portion 35A are lowered by the thickness of the metal plate, the inserting portion 34A is struck or stamped or deformed to form a locking claw 36A on the top side, and the receiving portion 35A is formed with a locking hole 37A. Further, the first superimposing portion 31A is struck or stamped or deformed at opposite sides of the receiving portion 35A to form shake preventing ribs 38A on the underside.

Both an inserting portion 34B and a receiving portion 35B of the second superimposing portion 31B substantially face outward, but are raised at least by the thickness of the conductive (metal) plate, the inserting portion 34B is struck or stamped or deformed to form a locking claw 36B on the underside, and the receiving portion 35B is formed with a locking hole 37B. Further, the second superimposing portion 31B is struck or stamped or deformed at opposite sides of the receiving portion 35B to form shake preventing ribs 38B on the top side.

At least one substantially L-shaped drag turning preventing piece 39 is bent at a substantially right angle toward the underside after projecting backward is formed on a bent part of the base end edge of the connecting fitting 30. As described later, the tip of the drag turning preventing piece 39 is to be fit into a fitting hole 2 formed in the mounting surface (see FIG. 2) when an assembly 40 formed by assembling the both ground terminals 10A, 10B with the fitting 30 is placed in contact with the mounting surface of the body.

The ground terminals 10A, 10B are respectively connected to ends of two ground wires W. For that, the ends of the ground terminals W are stripped to expose ends of cores Wa, and the wire connection portions are connected thereto, particularly the barrel pieces 22 of the wire barrel portions 20A, 20B are crimped or folded or bent or deformed and connected to be fixed to these exposed cores Wa.

After the ground terminals 10A, 10B are respectively connected to the ends of the ground wires W, the (particularly left) first ground terminal 10A and the (particularly right) second ground terminal 10B in FIG. 1 are respectively assembled with the first superimposing portion 31A and the second superimposing portion 31B of the connecting fitting 30.

Specifically, the main portion 11A of the first ground terminal 10A is at least partly placed on the underside of the first superimposing portion 31A while being shifted by a specified distance (e.g. substantially by a half width). Subsequently, when the main portion 11A is slid or displaced to the back side of the first superimposing portion 31A, the respective inserting portions 14A, 34A are pushed or displaced while being at least partly inserted into the mating receiving portions 35A, 15A. When the main portion 11A is pushed or displaced to a position where the bolt insertion holes 12, 32 are aligned, the locking claws 16A, 36A on the inserting portions 14A, 34A particularly are fixed by being fitted into the locking holes 37A, 17A of the mating receiving portions 35A, 15A as shown in FIG. 2.

Similarly, the main portion 11B of the second ground terminal 10B is placed on the top side of the second superimposing portion 31B while being shifted by a specified distance (e.g. substantially by a half width). Subsequently, when the main portion 11B is slid or displaced to the back side of the second superimposing portion 31B, the respective inserting portions 14B, 34B are pushed or displaced while being at least partly inserted into the mating receiving portions 35B, 15B. When the main portion 11B is pushed or displaced to a position where the bolt insertion holes 12, 32 are aligned, the locking claws 16B, 36B on the inserting portions 14B, 34B are fixed by being fitted into the locking holes 37B, 17B of the mating receiving portions 35B, 15B.

In this way, the assembly 40 is formed in which the first and second ground terminals 10A, 10B are assembled with the first and second superimposing portions 31A, 31B of the fitting 30. Here, since the first and second superimposing portions 31A, 31B are arranged that the center lines thereof intersect at the obtuse angle $\alpha$ in the fitting 30, the wire barrels 20A, 20B of the respective ground terminals 10A, 10B are in such postures to bring the barrel pieces 22 at the extending ends close or converging to each other as shown in FIG. 2.

Subsequently, a tape T particularly is spirally wound on and/or a (particularly shrinkable) tube and/or corrugated tube and/or at least one clip is placed on the both ground wires W to bundle the both ground wires W into a harness WH. As described above, since the barrel pieces 22 of the wire barrels 20A, 20B of the ground terminals 10A, 10B are close or adjacent to each other, the ground wires W drawn out from the respective ground terminals 10A, 10B are brought close to each other immediately behind the barrel pieces 22 and the bundling member can be easily arranged e.g. the tape T subsequently can be wound smoothly.

The harness WH is brought to an operation site of grounding in a state where the both ground terminals 10A, 10B are assembled with or by the fitting 30 to form the assembly 40 at an end of the harness WH as described above. At this operation site, the assembly 40 is placed in contact with the mounting surface in a state where left and right bolt insertion holes 42 (composed of or comprising the bolt insertion holes 12, 32) formed in the assembly 40 particularly substantially are aligned with the left and right screw holes 1 provided in the mounting surface of the body as shown in FIG. 2 and the tip of the drag turning preventing piece 39 is fitted in the fitting hole 2.

Figure 3:
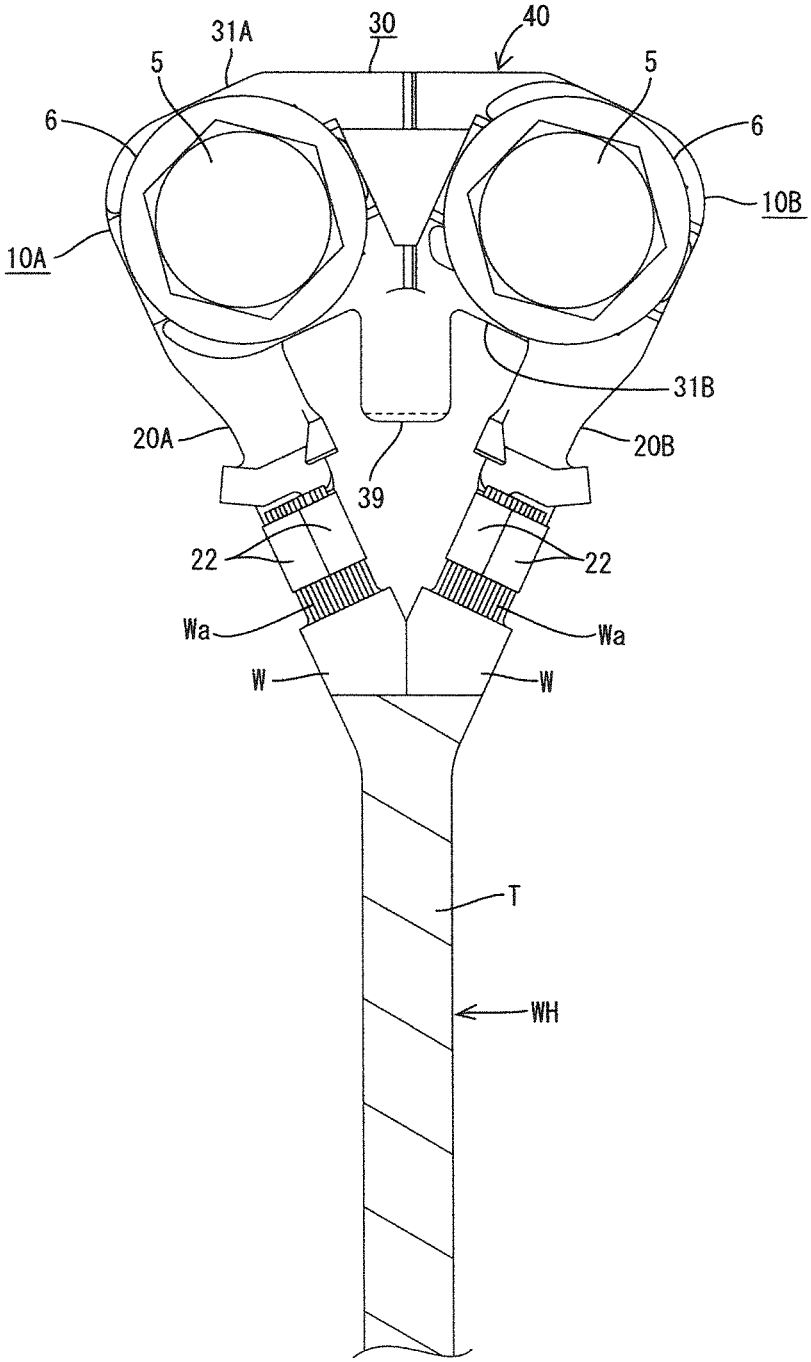
FIG. 3 is a plan view showing a state after the ground terminals are bolted.

Subsequently, as shown in FIG. 3, particularly bolts 5 with a washer 6 are successively inserted through the left and right bolt insertion holes 42 of the assembly 40 and threadably engaged with the screw holes 1. By screwing these bolts 5 using a tool such as a torque wrench, grounding can be performed by bolting the both ground terminals 10A, 10B at two positions.

Note that, at a side to be bolted first, the assembly 40 may be dragged to turn due to frictional engagement between the washer 6 of the bolt 5 and a surface of the assembly 40 at a final stage of bolting, but such drag turning particularly is prevented by fitting the at least one drag turning preventing piece 39 provided on the connecting fitting 30 into the fitting hole 2 provided in the mounting surface. Thus, the bolt 5 can be efficiently tightened and, consequently, a bolt tightening operation at two positions can be performed in a short time.

As described above, according to this embodiment, when the assembly 40 is formed by placing and coupling the first and second ground terminals 10A, 10B to the corresponding superimposing portions 31A, 31B of the fitting 30, the barrel pieces 22 at the extending ends of the wire barrels 20A, 20B of the respective ground terminals 10A, 10B are located close to each other since the center lines of the superimposing portions 31A, 31B of the fitting 30 intersect at the obtuse angle $\alpha$. As a result, the two ground wires W drawn out from the respective wire barrels 20A, 20B are brought close to each other at the position immediately behind the barrel pieces 22. Specifically, the respective ground terminals 10A, 10B are assembled in a specified positional relationship via the fitting 30 and the ground wires W drawn out from the respective ground terminals 10A, 10B are brought close to each other immediately behind the barrel pieces 22. Thus, the operation of forming the harness WH by arranging a bundling member, particularly by winding the tape T, on the both ground wires W can be performed efficiently.

Note that if the respective wire barrels 20A, 20B substantially extend in parallel to each other when the respective ground terminals 10A, 10B are assembled via a connecting fitting, the ground wires W drawn out from the barrel pieces 22 cannot be brought close to each other immediately behind the barrel pieces 22 and need to be brought close to each other after substantially extending a certain distance straight. Specifically, an extra length is necessary and this extra length part takes up an extra space on the mounting surface.

Contrary to this, the ground wires W drawn out from the respective wire barrels 20A, 20B naturally come close to each other immediately behind the barrel pieces 22, as described above. Thus, the ground wires W need not have an extra length and space saving is realized.

Although the both ground terminals 10A, 10B are bolted at two positions in grounding, operations of aligning and positioning the bolt insertion holes 12 of the respective ground terminals 10A, 10B with respect to the screw holes 1 of the mounting surface can be performed at once since the respective ground terminals 10A, 10B are assembled via the connecting fitting 30. As a result, a grounding operation by bolting can be efficiently performed.

Particularly, in this embodiment, the connecting fitting 30 as a new part is necessary, but ground terminals having the existing shapes can be used as the ground terminals 10A, 10B as they are. Thus, a cost increase can be suppressed.

Figure 4:
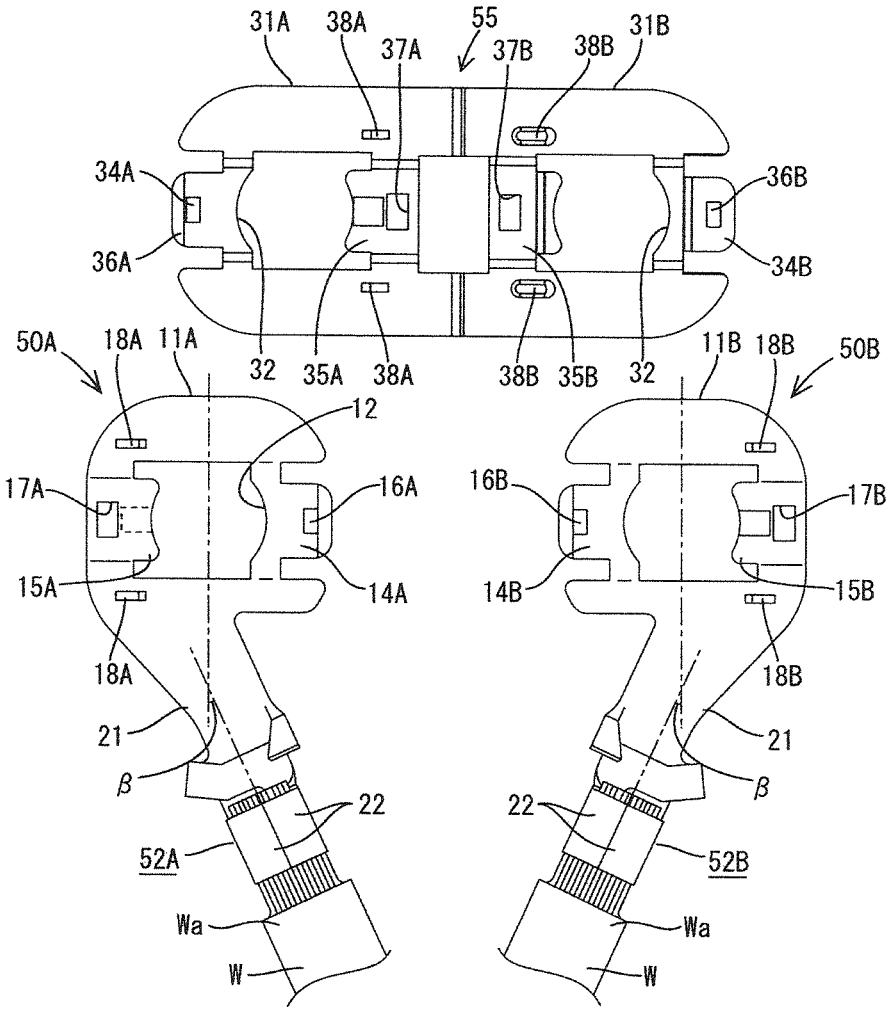
FIG. 4 is a plan view showing a state before ground terminals according to a second embodiment of the present invention are assembled with a connecting fitting.

A second embodiment of the invention is described with reference to FIGS. 4 to 6. In this second embodiment, the shape of a connecting fitting 55 and the postures of wire barrels 52A, 52B provided on ground terminals 50A, 50B are changed as compared with the first embodiment.

Points of difference from the first embodiment are mainly described below and parts and the like having the same or similar configuration and/or the similar or same functions as in the first embodiment are denoted by the same reference signs and not described or only briefly described.

The wire barrels 52A, 52B provided on the (left and right) ground terminals 50A, 50B substantially extend backward from positions at sides distant from the mating ground terminals on the base end edges of main portions 11A, 11B near end parts as in the above first embodiment. However, the wire barrels 52A, 52B are in a posture inclined inwardly by an angle of between about 15° to about 35° (e.g. of about 25°) so that parts of the barrel pieces 22 at extending ends come close to each other.

On the other hand, in the connecting fitting 55, a first superimposing portion 31A and a second superimposing portion 31B similar to those shown in the first embodiment are laterally formed particularly substantially on a straight line.

Also in the second embodiment, the main portion 11A of the first ground terminal 50A is to be at least partly placed on the underside of the first superimposing portion 31A and pushed or displaced to the back side and the main portion 11B of the second ground terminal 50B is at least partly placed on the top side of the second superimposing portion 31B and pushed or displaced to the back side, thereby forming an assembly 60 in which the both ground terminals 50A, 50B are assembled with the connecting fitting 55.

Although the connecting fitting 55 has a linear shape in this second embodiment, the wire connection portions (particularly the wire barrel portions 52A, 52B) of the respective ground terminals 50A, 50B are formed to have an inclined posture in advance. Thus, when the assembly 60 is formed, the both wire connection portions (particularly the both wire barrel portions 52A, 52B) are in such postures to bring the parts of the wire connection portions (particularly the barrel pieces 22 at the extending ends of the both wire barrel portions 52A, 52B) close to each other. Therefore, ground wires W drawn out from the respective ground terminals 50A, 50B are brought close to each other immediately behind the parts of the wire connection portions (particularly the crimping pieces 22). Since the both ground terminals 50A, 50B are assembled in a specified (predetermined or predeterminable) positional relationship, an operation of forming a harness WH by arranging a bundling member (particularly by winding a tape T) on the both ground wires W can be efficiently performed.

Figure 5:
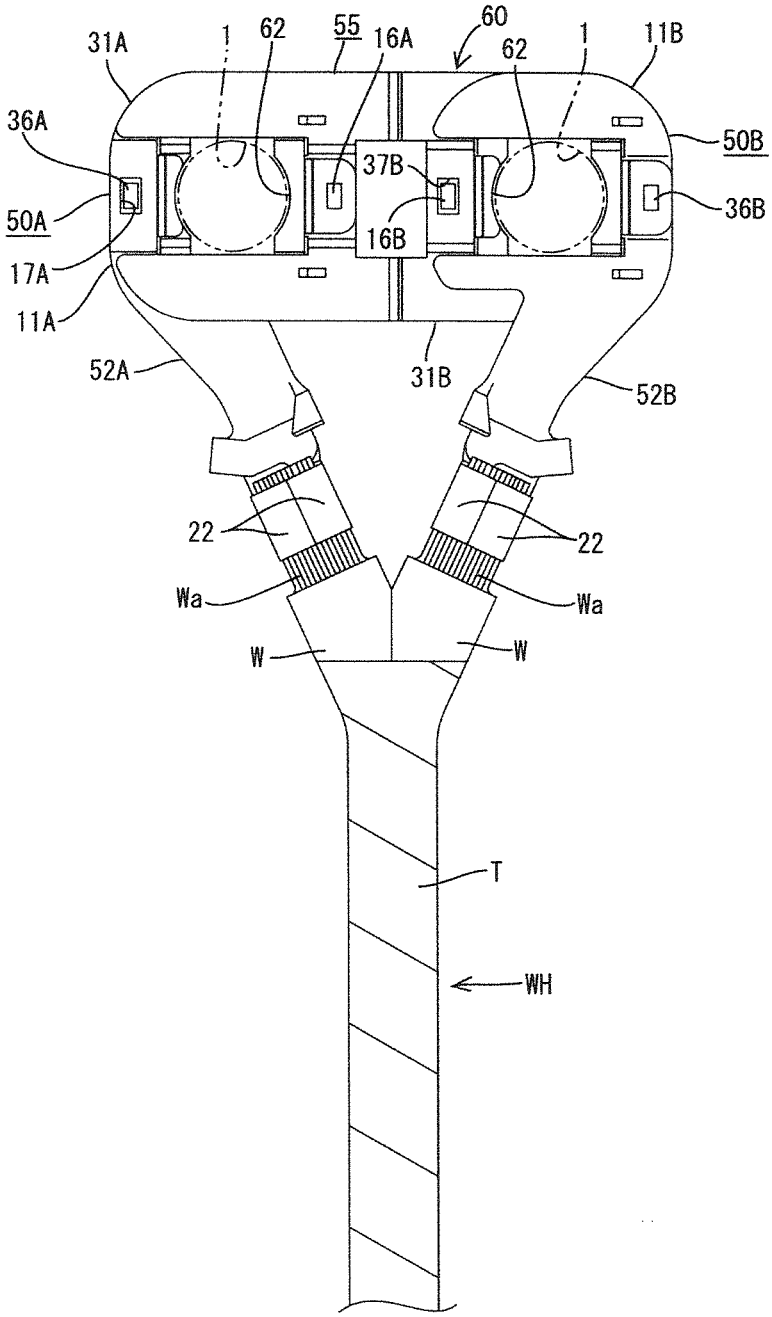
FIG. 5 is a plan view showing a state after the ground terminals are assembled with the connecting fitting.
Figure 6:
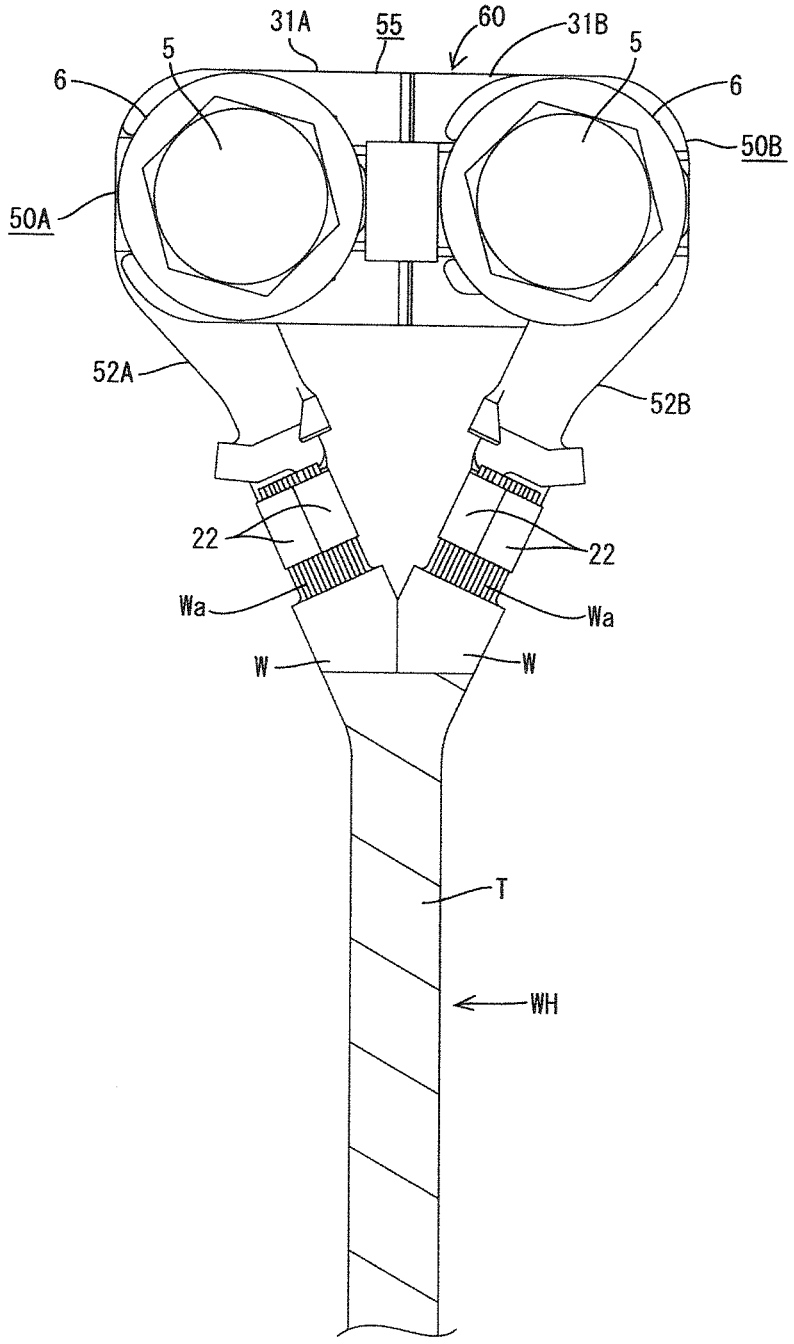
FIG. 6 is a plan view showing a state after the ground terminals are bolted.

At a site of grounding, as shown in FIG. 5, (left and right) first and second bolt insertion holes 62 formed in the assembly 60 substantially are aligned with (left and right) first and second screw holes 1 provided in a mounting surface of a body and this assembly 60 is placed in contact with the mounting surface. Subsequently, as shown in FIG. 6, bolts 5 with a washer 6 particularly are inserted through the respective bolt insertion holes 62 and threadably engaged with the screw holes 1. By screwing these bolts 5 using a tool such as a torque wrench, grounding can be performed by bolting the both ground terminals 50A, 50B at two positions.

Also in this second embodiment, as in the above first embodiment, it is possible to obtain effects that an operation of forming a harness by bundling the both ground wires W (particularly by winding the tape T on the both ground wires W) can be performed efficiently, the ground wires W need not have an extra length, space saving can be realized and further an operation of aligning and positioning the bolt insertion holes 12 of the respective ground terminals 50A, 50B with respect to the screw holes of the mounting surface can be performed at once.

Particularly, since the fitting 55 particularly substantially can have a linear shape in this second embodiment, the production of the fitting 55 can be simplified.

The invention is not limited to the above described embodiments. For example, the following embodiments are also included in the scope of the invention.

In the first embodiment, the angle a at which the center lines of the respective superimposing portions 31A, 31B of the connecting fitting 30 intersect can be arbitrarily selected according to conditions such as the length of the wire barrel portions 20A, 20B, i.e. as long as the extending ends of the wire barrel portions 20A, 20A can be arranged particularly as close as possible to each other without interfering when the assembly 40 is formed.

In the second embodiment, an angle β of the wire barrels 52A, 52B provided on the respective ground terminals 50A, 50B can be arbitrarily selected according to conditions such as the length of the wire barrels 52A, 52B likewise as long as the extending ends of the wire barrels 52A, 52B can be arranged particularly as close as possible to each other without interfering when the assembly 60 is formed.

The connecting fitting of the second embodiment may also be provided with a drag turning preventing piece.

Although two ground terminals are bolted at two positions in the above embodiments, the present invention can be similarly applied also when three or more ground terminals are bolted at three or more positions.

Although the assembly is fixed to the body by bolting in the above embodiments, the invention can be applied also when the assembly is fixed by inserting stud bolts standing on the body through the bolt insertion holes of the assembly and threadably engaging nuts with the tips of the stud bolts and tightening the nuts.

Although taping is illustrated as a means for bundling the ground wires into the harness in the above embodiments, the harness may be formed using another bundling device such as a corrugated tube or a clip or a shrinkable tube and the use of such devices is also included in the technical scope of the present invention.

Although in the above embodiment, the ground terminals are formed with at least one wire barrel for connection with the respective wire, it should be understood that the wire connection portion may be connected to the wire(s) by other means than crimping such as by soldering, welding, bolting, insulation displacement or the like.

What is claimed is:

1. A ground terminal assembly structure, comprising:

left and right ground terminals, each of the ground terminals having a main portion formed with a bolt insertion hole and a wire connection portion extending from a main portion, the wire connection portion, being configured to be connected to a ground wire, the left and right ground terminals being formed so that the main portions thereof are placeable one on the other and the wire connection portions extend substantially in parallel to each other from the main portions; and a fitting including a plurality of superimposing portions, each of the superimposing portions being formed with a bolt insertion hole and on which the main portions of the ground terminals being placed on and connected to the superimposing portions, the fitting having a mountain shape configured so that the superimposing portions are arranged laterally of each other with the superimposing portions being at a specified obtuse angle with respect to each other;

wherein the wire connection portion of the respective ground terminals are arranged in postures so that extending ends thereof come approach each other when the main portions of the respective ground terminals are placed on and connected to the corresponding superimposing portions of the fitting at positions where the bolt insertion holes are substantially aligned.

2. The ground terminal assembly structure of claim 1, wherein the fitting is formed with at least one drag turning preventing piece that is engageable with a mating member, to which the fitting is to be bolted, and prevents drag turning in bolting.

3. A ground terminal assembly structure, comprising:

left and right ground terminals, each of the ground terminals having a main portion formed with a bolt insertion hole and a wire connection portion extending from a main portion, the wire connection portion being configured to be connected to a ground wire; and a fitting including a plurality of superimposing portions, each of the superimposing portions being formed with a bolt insertion hole and the main portions of the ground terminals being placed on and connected to the superimposing portions; and wherein the left and right ground terminals are formed and are arranged in postures so that extending ends of the wire connection portions extend from the main portions obliquely to bring the extending ends close to each other when the main portions of the respective ground terminals are placed on and connected to the corresponding superimposing portions of the fitting at positions where the bolt insertion holes are substantially aligned.

4. The ground terminal assembly structure of claim 3, wherein the fitting is formed so that two of the superimposing portions are arranged substantially laterally on a straight line.

* * * * *